United States Patent [19]

Hall

[11] Patent Number: 4,791,892

[45] Date of Patent: Dec. 20, 1988

[54] TWO-STROKE ENGINE

[76] Inventor: Roger M. Hall, 445 Ashmore Road, Ashmore, Queensland, Australia

[21] Appl. No.: 27,834

[22] Filed: Mar. 19, 1987

[30] Foreign Application Priority Data

Mar. 21, 1986 [AU] Australia ..... PH5144
Nov. 14, 1986 [AU] Australia ..... PH8964

[51] Int. Cl.[4] ..... F01L 11/00

[52] U.S. Cl. ..... 123/47 R; 123/149 C; 123/182; 123/599

[58] Field of Search ..... 123/74 AE, 47 R, 149 C, 123/149 D, 182, 197 AC, 599

[56] References Cited

U.S. PATENT DOCUMENTS

| | | | |
|---|---|---|---|
| 1,229,217 | 6/1917 | Brougham | 123/65 VC |
| 1,274,980 | 8/1918 | Brevard | 123/74 AE |
| 1,287,509 | 12/1918 | Sullivan | 123/65 VC |
| 1,322,488 | 11/1919 | Hall | 123/65 VC |
| 1,740,235 | 12/1929 | Fogas | 123/74 AE |
| 3,747,649 | 7/1973 | Denson et al. | 123/599 |
| 4,155,340 | 5/1979 | Fernquist et al. | 123/602 |
| 4,491,097 | 1/1985 | Hamann | 123/197 AC |
| 4,512,291 | 4/1985 | Kirk | 123/197 AC |

*Primary Examiner*—Charles J. Myhre
*Assistant Examiner*—David A. Okonsky
*Attorney, Agent, or Firm*—Renner, Otto, Boisselle & Sklar

[57] ABSTRACT

A two stroke engine including a single piston housing, a transfer port, an inlet port in the housing, an exhaust port in the housing, a piston located in the housing, a connecting rod integral with or otherwise rigidly secured to the piston, a crankcase located adjacent to the piston, a crankshaft in the crankcase, pivotal connection means between the crankshaft and connection rod to facilitate rotation of the crankshaft in the crankcase, and electronic ignition means located within the crankcase. Preferably the crankshaft is provided with a magnet for passage by the electronic ignition means to effect firing of the engine. The ignition means is movable within the crankcase to achieve a position in advance or retard of top dead center. Preferably there is further provided a decompression valve in a top part of the piston to achieve easier starting of the engine.

18 Claims, 5 Drawing Sheets

TWO-STROKE ENGINE

This invention relates to a two-stroke engine suitable for lawnmowers, chain saws, brushcutters, generators, edge cutters, compactors and the like. It will be appreciated from the above examples that the two-stroke engine of the invention therefore is applicable not only to mobile apparatus but also stationary apparatus. Primarily however, the invention is applicable to lawnmower engines.

BACKGROUND OF THE INVENTION

A conventional fan scavenged two-stroke internal combustion engine comprises piston adapted for reciprocatable vertical movement in a cylinder. The piston is attached by a connecting rod to a crankshaft which rotates in a housing or crankcase located below the cylinder and which is in open communication therewith. At the start of the first stroke the piston is in its highest position and when a mixture of compressed petrol (gasoline) and air above the piston is ignited the piston is thrust downwardly and in so doing releases an exhaust port in the cylinder. The burned gases in the cylinder which are still under high pressure can thus escape through this port. When the piston descends further its upper surface may release an inlet port in the cylinder which admits fresh petrol and air moisture into the cylinder so that the remaining burned gases are flushed out. When the piston rises again in its second stroke both exhaust port and inlet ports are closed for a time and during this period the petrol and air mixture is compressed so that a fresh cycle can commence. A fan is located in or adjacent to the inlet port to force fresh petrol and air mixture into the cylinder.

A conventional crankcase scavenged two stroke internal combustion engine has no scavenging fan. Instead the crankcase is hermetically sealed so that it can function as a pump in conjunction with the piston. When the piston ascends, a partial vacuum is produced in the crankcase until a lower surface of the piston releases an inlet port and this opens the way for fresh petrol and air mixture into the crankcase. When the piston descends, the mixture in the crankcase is compressed slightly so that as soon as a top surface of the piston releases a transfer port or overflow duct in the cylinder which connects the crankcase to the cylinder the compressed mixture may enter the cylinder through the transfer port above the piston.

In the fan scavenged two stroke engine the fan adds to the cost. However as the transfer port between the cylinder and crankcase is eliminated, the crankshaft can be provided with forced-oil lubrication without involving a risk that oil in the crankcase can find its way in the cylinder In the cheaper crankcase scavenged engine the lubricating oil is mixed with petrol or alternatively is supplied to the points of lubrication dropwise by small lubricating oil pumps The oil which enters the crankcase is liable to be carried through the transfer port into the cylinder whence it passes through the exhaust port.

Disadvantages of conventional two stroke engines of the type referred to above include (1) because the crankcase is in open communication with the cylinder the burnt gases arising out of combustion can be corrosive to the cylinder and crankcase. Also impurities can gain access to the cylinder or crankcase causing wear and tear on bearing surfaces causing frequent maintenance checks, (2) the connecting rod is pivotally connected to both crankshaft and piston thus causing friction between piston and cylinder and undue wear and tear on pivotal interconnections between crankshaft and connecting rod and piston and connecting rod, (3) excessive number of moving parts; and (4) the thrust transmitted to the crankpin which pivotally interconnects the connecting rod and crankshaft is not in a straight line and thus power losses may occur.

Reference may be made to two-stroke cycle spark ignition engines employing a scotch-yoke crankshaft mechanism which are described generally in a paper by David Kirk in SAE Technical Paper Series 851518 based on the 1985 International Off-Highway and Powerplant Conference and Exposition held at Mecca, Milwaukee, Wis. USA on Sept. 9–12, 1985.

In this paper reference is made to a two stroke cycle spark ignition engine intended for light aircraft propulsion. A modified scotch yoke crank mechanism is employed and by two such reciprocating assemblies set at right angles to each other a compact 4-cylinder radial engine configuration results. The conventional scotch yoke mechanism as described in the above reference therefore included two identical tubular piston rods having integral heels attached by bolts to a yoke member which may therefore reciprocate back and forth. A crankshaft was rotatably attached to a slipper such as a roller block slidably mounted in the yoke. Upon reciprocatable movement of the piston rods rotation of the crankshaft in the crankcase was therefore effected. The Kirk engine is provided with a single magneto located on the exterior of the engine and driven directly from the, accessory end of the crankshaft.

Reference is made to Albertson U.S. Pat. No. 3,617,652 which also described various forms of scotch yoke mechanisms which however are all based on the general principle as described above. U.S. Pat. Nos. 981,995; 1,181, 892; 2,122,676; 2,122,677; 2,172,670; 2,147,666; 4,013,048; 4,331,108 and French Pat. No. 595,04 are also mentioned in the aforementioned Kirk reference but are not believed relevant to the present invention. Of the aforementioned references Reitz U.S. Pat. No. 4,013,048 is the most interesting reference as it also described a modified Scotch crank mechanism.

However, there has long been a requirement for a two stroke engine based on the Scotch crank principle which could be applied to a single piston and cylinder arrangement which is most efficacious in regard to lawn mower engines which usually require a manual pull start. However as set out above, most lawn mower engines have been manufactured on the conventional fan scavenged or crankcase scavenged arrangement as described above with the consequential disadvantages.

SUMMARY OF THE INVENTION

The invention provides an improved two stroke internal combustion engine which alleviates the abovementioned disadvantages of the prior art.

The engine of the invention includes;

(a) a single piston housing;

(b) a transfer port;

(c) an inlet port in the housing;

(d) an exhaust port in the housing;

(e) a piston located in the housing;

(f) a connecting rod integral with or otherwise rigidly secured to the piston;
(g) a crankcase located adjacent to the piston housing but sealed therefrom;
(h) a crankshaft in the crank case; and
(i) pivotal connection means between the crankshaft and connection rod to facilitate rotation of the crankshaft in the crankcase; and
(j) electrical ignition means located within the crankcase.

The two stroke engine of the invention is therefore a modification of the prior art and in particular the scotch crank arrangement as described previously in that instead of opposed pistons located in associated piston housings or cylinders there is now utilized a single piston housing and associated piston connection to the crankshaft by the aforementioned pivotal connection means.

Suitably the piston housing has a continuous side wall and base wall and top wall. The piston housing may be cylindrical although any other suitable cross sectional shape may be utilised such as being rectangular or polygonal. Preferably the piston housing has cooling means associated therewith such as cooling fins as is known in the art. The piston housing suitably has ignition means such as a spark plug located in a top aperture therewith in the usual manner.

The piston housing also has a inlet port located in a side wall thereof which suitably is below the exhaust port which is also suitably located in the side wall of the piston housing.

The piston may have a cross sectional shape similar to that of the piston housing and there also may be provided sealing means such as sealing rings located in retaining grooves in an external surface of the piston to seal the top surface of the piston from the base surface thereof as is known in the art.

There also may be provided a transfer port in the piston housing to facilitate transfer of fluid or gases from below a bottom surface of the piston to above the top surface. In one form this may comprise an overflow duct or tube-like passage attached to the side wall of the piston housing.

However, in an alternative embodiment the transfer port may be located within the piston suitably associated with a check valve such as a spring loaded ball or flap valve.

The connecting rod may be integral with the piston or rigidly secured thereto so that the assembly of connecting rod and piston move as one unit. Suitably rigid securing means for this purpose may comprise a rivet, bolt and nut or the like The piston housing as mentioned above may have a base wall which seals the interior of the piston housing from the interior of the crankcase.

Suitably the base wall is provided with a locating aperture to facilitate reciprocating movement of the connecting rod.

The crankcase may have any suitable shape such as cylindrical or cuboidal. Preferable the crankcase has associated therewith suitable starting means such as a rotatable plate engageable with a pulling cord having one or more pivoted pawls as is known in the art engaging with the pivotal attachment means. Alternatively a starter motor arrangement could be utilised having a flywheel associated therewith.

The crankcase also may have a mounting plate attached to a base surface thereof having attachment apertures for attachment to a mounting frame of suitable stationary or mobile apparatus as described above. The crankcase may be provided with a depending sleeve in use for support or location of the drive spindle which is integral or rigidly secured to the crankshaft. The drive spindle may have bearing means associated therewith as is known in the art. The drive spindle at its outer free end may have attached thereto a blade support plate of a lawnmower as is known in the art.

The pivotal attachment means in one form includes a mounting bracket or yoke integral with or rigidly secured to the connection rod by any suitable rigid attachment means such as a nut and bolt, rivet or the like. A socket member may be screw threadedly retained in a retaining aperture in the yoke and the connection rod may be screw threadedly returned in the socket member.

Mounted within the mounting bracket or yoke may be a slide block or slide roller slidably mounted for reciprocatable movement within the retaining aperture. The slide block is suitably formed from relatively low friction material such as plastics or an acetal resin sold by E. I. Du Pont de Nemours & Co. Inc. under the trademark DELRIN. Attached to the slide block may be a crankpin integral with or rigidly secured to the crankshaft and held in place with a retaining washer. The crankpin may engage with the starting means in a manner as described above.

The crankshaft may have any suitable shape such as being a solid disc preferably provided with means for counterbalancing the weight of the pivotal attachment means. The counterbalancing means may comprise peripheral cut outs, slots or apertures located adjacent to the pivotal attachment means.

The crankshaft if desired may also be provided with a magnet located in a retaining slot in the crankshaft by suitable releasable attachment means such as screw mounted attachment plates or blocks.

The crankcase may also have electric ignition means located there in which is suitably releasably attached to an internal surface thereof by a suitably supported bracket. The electronic ignition means is electrically connected to the spark plug so that as the magnet in the crankshaft passes the electronic ignition means it will induce a current to flow to the spark plug to fire combustion gases in the cylinder when required i.e. when the piston is approaching the limit of its upward reciprocating movement.

BRIEF DESCRIPTION OF THE DRAWINGS

Reference may now be made to the preferred embodiment of the invention as shown in the attached drawings wherein.

DETAILED DESCRIPTION

Figure 2:
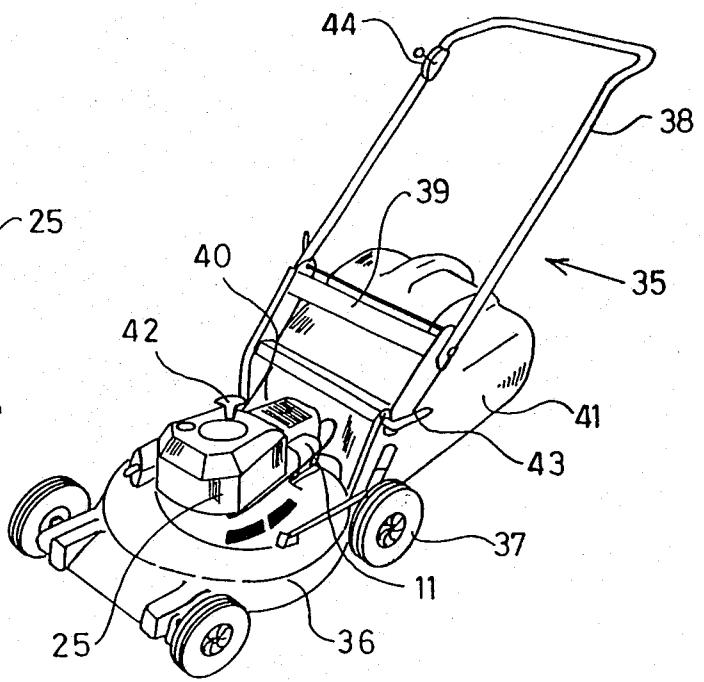
FIG. 2 is a perspective view of a lawnmower incorporating the two stroke engine shown in FIG. 1.
Figure 1:
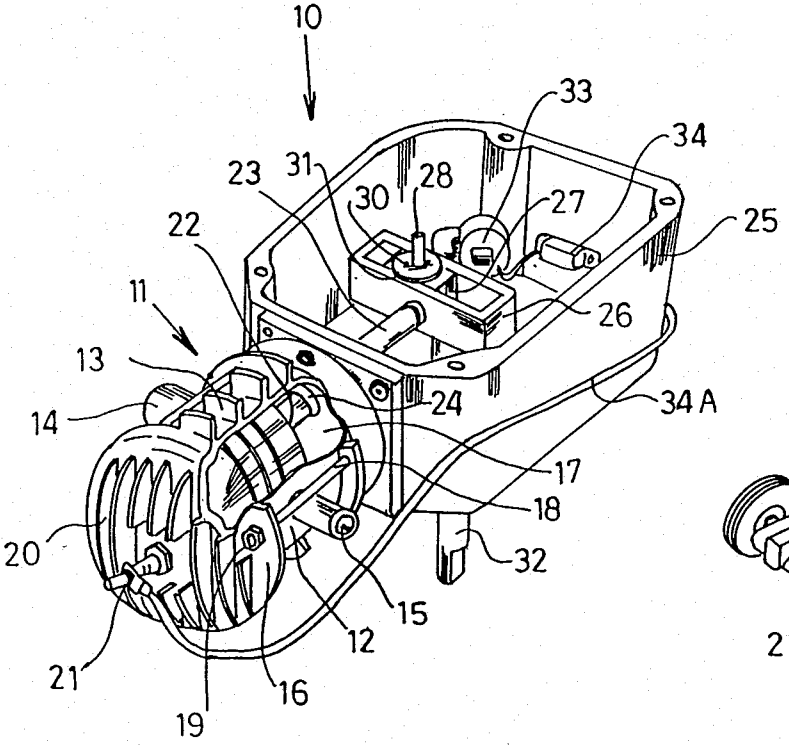
FIG. 1 is a perspective view of a two stroke engine constructed in accordance with the invention.

The engine 10 in FIG. 1 includes piston housing 11 having side wall 12 and cooling fins 13. Also shown is inlet port 14 and exhaust port 15. Piston 11 has top end wall 16 and base wall 17 interconnected by bolts 18 and nuts 19. Top wall 16 has cooling fins 20 and spark plug 21 mounted therein. Piston 22 is slidably reciprocatable in housing 11 and is provided with connecting rod 23 integral therewith which passes through locating aperture 24 in base wall 17. There is also shown crankcase 25 which encloses mounting bracket 26 rigidly attached to connecting rod 23 and slide block 27 mounted for slidable reciprocating movement therein. Also shown is crankpin 28 integral with or rigidly secured to crankshaft 29. Crankpin 28 is secured to slide block 27 y washer 30 and releasable fastener 31. Crankshaft 29 is integral with drive shaft 32. There is also provided electronic ignition means 33 controlled by control unit 34. Also shown is electrical cable 34A interconnecting spark plug 21 and ignition means 33.

The lawnmower 35 containing engine 10 has chassis 36 supported by ground engaging wheels 37. There is also shown handle 38, cross members 39 and 40 and rear catcher 41. Pull start actuator 42 is connected to crankpin 28 in a manner as described above. Also shown is lever 43 allowing handle 38 to be pivoted relative to cross member 40 for transportation purposes and fuel control unit 44 attached to handle 38.

Figure 3:
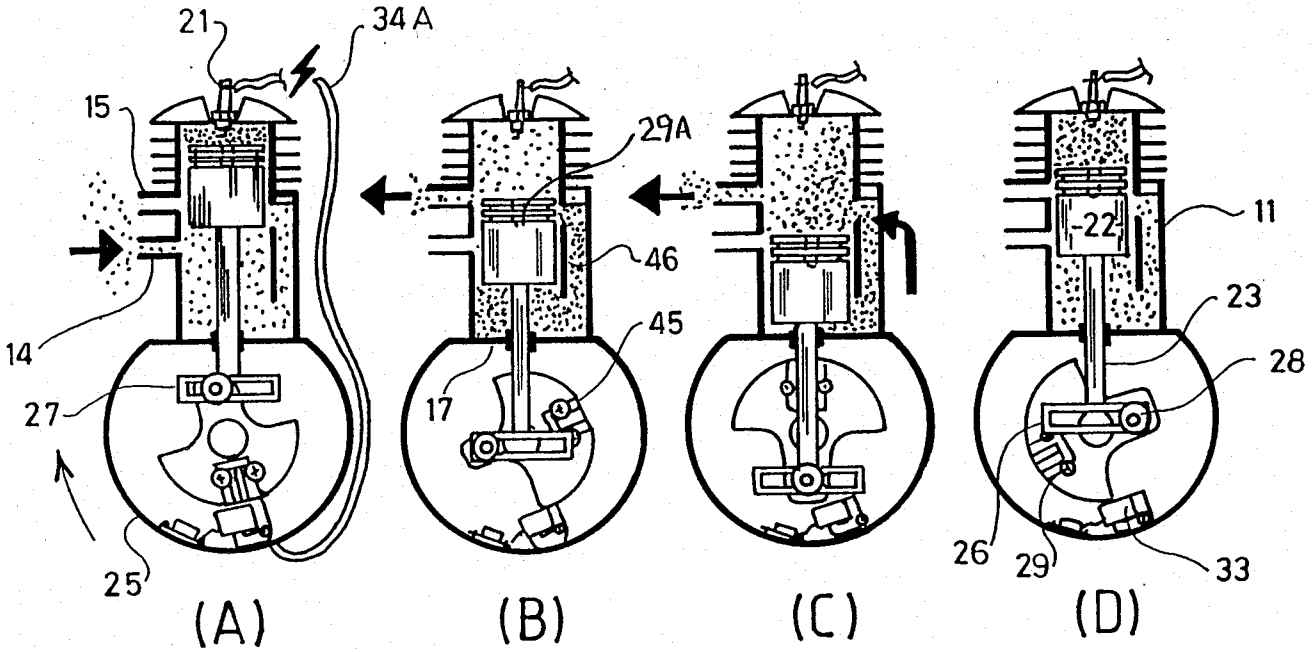
FIGS. 3(A)–3(D) are series of schematic views showing various stages in the operating cycle of the two stroke engine shown in FIG. 1.

In FIG. 3 there is shown the sequence of events that occurs in regard to operation of the engine of FIG. 1. In FIG. 3A magnet 45 mounted on crankshaft 29 is located adjacent to electronic ignition means 33 thereby passing an electrical current to spark plug 21 through cable 34A. This results in combustion of gases above piston 22 which are the mixture of air and petrol. The piston 22 is subsequently thrust downwardly as shown in FIG. 3(B). In FIG. 3(A) gases may enter the piston housing 11 through inlet port 14. As piston 22 descends in FIG. 3(B) this compresses gases in piston housing 11 below piston 22. The exhaust port 15 is open and burnt gases may escape.

In FIG. 3(C) the transfer port 46 is now open and gases may flow into piston housing 11 above piston 22 from below as shown. Burnt gases may still escape through exhaust port 15. When the piston 22 rises in FIG. 3(D) ports 15 and 46 are closed and gases are compressed above piston 22. Crankcase 25 is sealed from piston housing 11 by end wall 17 and thus slide block 27 is free to reciprocate back and forth in bracket 26 shown through the action of connecting rod 23 which is rigidly attached to bracket 26. Crankpin 28 is rigidly attached to crankshaft 29 which rotates as shown upon movement of slide block 27. Crankshaft 29 has magnet 45 which acts to fire gases above piston 22 as shown in FIG. 3(A) above. Also shown is decompression valve 29A described in greater detail hereafter.

Figure 4:
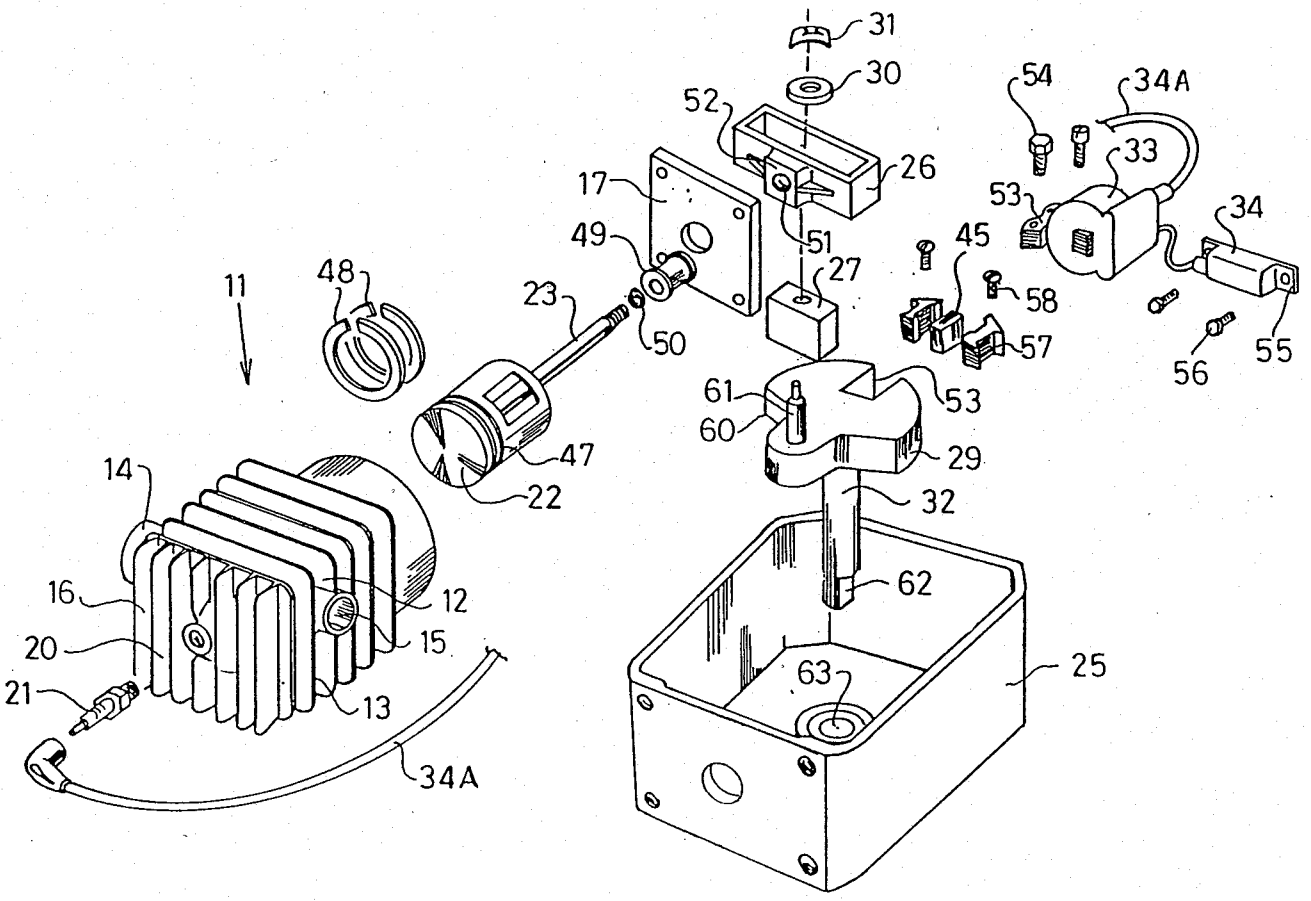
FIG. 4 is an exploded perspective view of the two stroke engine shown in FIG. 1.

In the exploded view shown in FIG. 4 piston 22 is provided with retaining grooves 47 for seating rings 48 as shown. Connecting rod 23 engages in mounting socket 49 with the aid of circlip 50. Threaded end 50A of connecting rod 23 engages in mating aperture 51 of mounting bracket 26 wherein aperture 51 is located in boss 52. Electronic ignition unit 34 is attached to the internal surface of crankcase 25 by screws 54 engaging with securing bracket 53.

Control unit 34 is also attached to the internal surface of crankcase 25 by screws 56 engaging with holding lugs 55 as shown. Magnet 45 is retained in mounting recess 53A by holding lugs 57 and screws 58 as shown. Crankshaft 29 is provided with counterbalancing slots or cut outs 60 and slide block 27 is mounted on mounting post 61 of slide block 27. Shaft 32 of crankshaft 29 is provided with notch 62 for engagement with a blade mounting plate (not shown) and may extend through aperture 63 of crankcase 25.

In another embodiment of the invention the electronic ignition means may be movable from a position in advance or a retard position relative to top dead centre (TDC) which is shown in FIG. 3A. Suitably an advance position may be up to 35° in advance of TDC and a retard position may be up to 5° in retard of TDC. These values are representative of a range at which the spark plug may fire with consequential fuel combustion.

In one form of achieving this objective the electronic ignition means may be movable to achieve an advance or retard position as described above. This may promote easier starting, between idling and better performance of the engine. Thus in certain circumstances it may be beneficial to move the electronic ignition means from a retard setting to an advance setting. Thus the electronic ignition means may be initially in a retard setting when the engine is started and moved substantially to an advance position to develop more power. In this regard the engine would be easier to start in a retard position because of lower compression resistance and quicker combustion.

Figure 5:
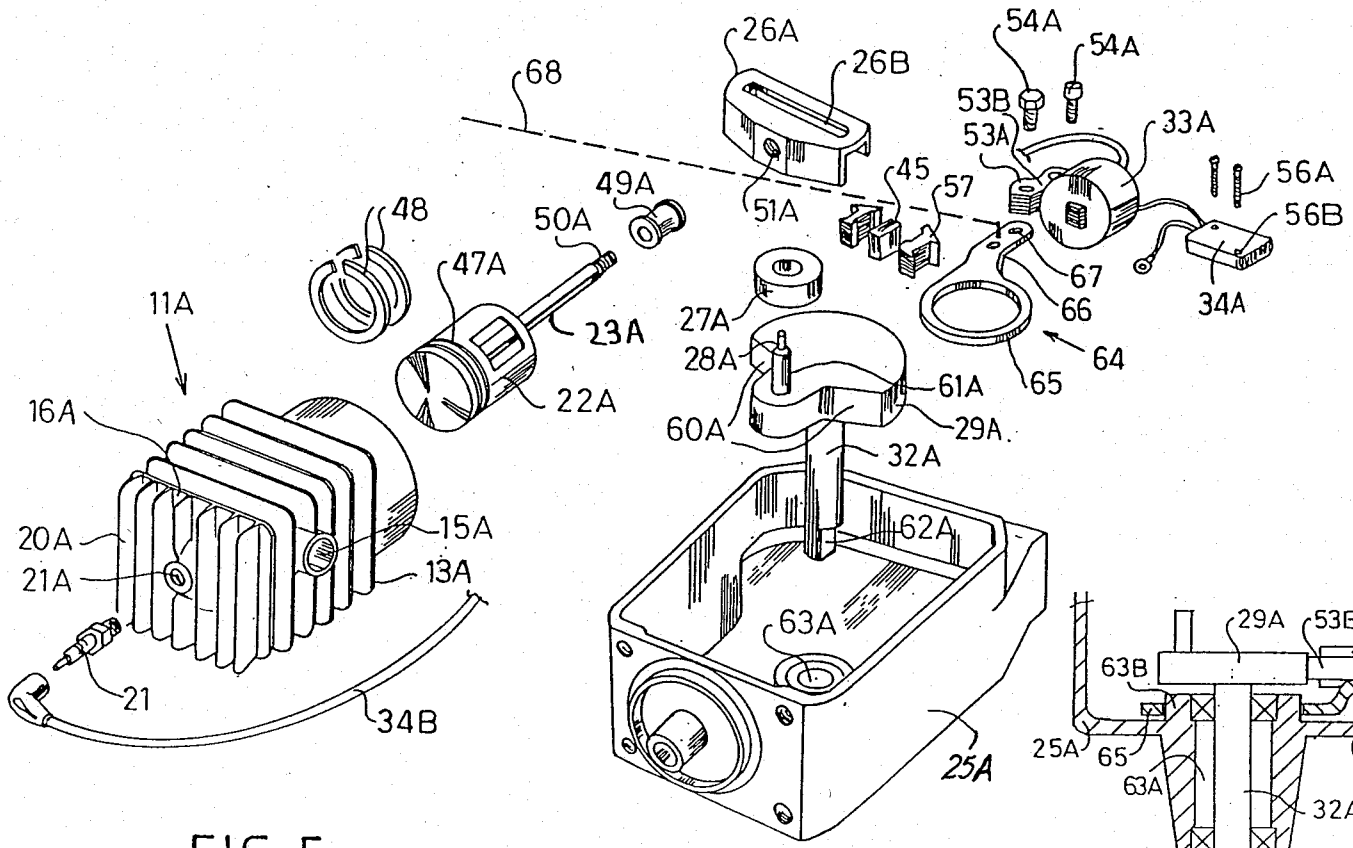
FIG. 5 is an exploded perspective view of a two stroke engine constructed in accordance with the invention and incorporating this embodiment.
Figure 6:
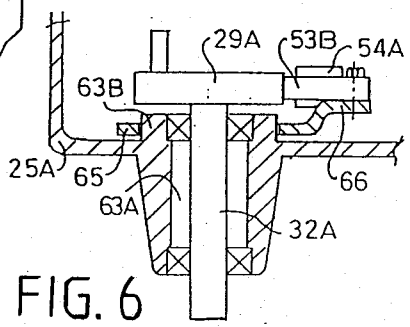
FIG. 6 is a sectional view of the mounting means for mounting the electronic ignition means which mounting means is axially movable.

This embodiment is shown in FIGS. 5–6 wherein there is shown piston housing 11A having cooling fins 13A in a side wall thereof as well as outlet port 15A. The inlet port is hidden from view. In front wall 16A of piston housing 11A there are provided cooling fins 20A. Spark plug 21 is mountable in aperture 21A. Piston 22A is slidably reciprocated in housing 11A and is provided with connecting rod 23A integral therewith. Also shown is crankcase 25A which encloses mounting bracket 26A rigidly attached to connecting rod 23A wherein threaded end 50A of connecting rod 23A engages in mating aperture 51A of bracket 26A. This is also achieved through the agency of mounting socket 49A. Bracket 26A is provided with slot 26B. Crankpin 28 is adapted to slide in slot 26B. Crankshaft 29A is integral with drive shaft 32A. The electronic ignition means 33A which is controlled by control unit 34A has one end connected to cable 34B which is attached to spark plug 21 as shown. Piston 22A has retaining grooves 47A for sealing rings 48. Magnet 45 is retained in position by holding lugs 57. Crankshaft 29A is provided with counterbalancing slots 60A and the slide block 27A in the form of a roller is mounted on mounting post 61A. Shaft 32A is provided with notch 62A for engagement with a blade mounting plate (not shown) and may extend through aperture 63A of crankcase 25A.

In additional embodiment referred to above there is provided mounting member 64 for electronic ignition means 33A. The mounting member 64 includes circular part 65 and attachment lug 66 having attachment apertures 67 for electronic ignition means 33A. Screws 54A may be used to attach ignition means 33A to lug 66. The screws 54A may extend through mating apertures 53A in lug portion 53B of ignition means 33A. There also may be provided cable 68 interconnecting mounting member 64 to the carburetor and which may effect rotation of mounting member 64 when desired.

Figure 7:
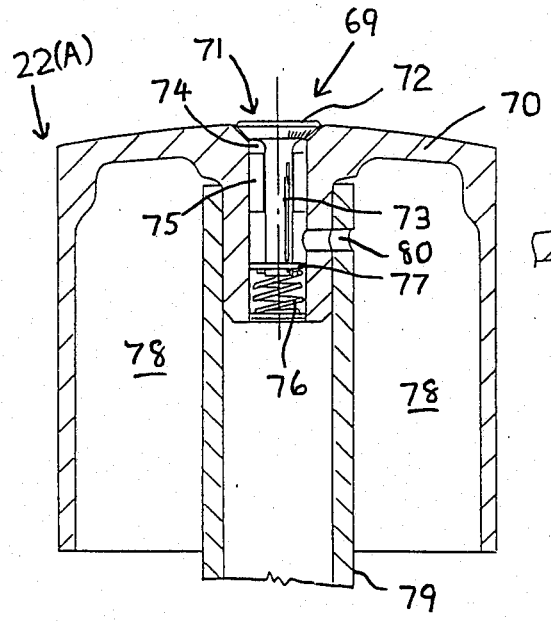
FIGS. 7–8 are views of an appropriate decompression valve for use in a top part of the piston wherein when the decompression valve is opened gases flow through the decompression valve to gain access to the piston housing chamber below the piston.
Figure 8:
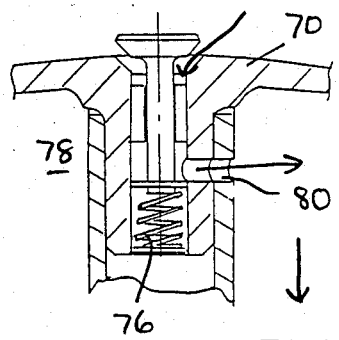
Figure 10:
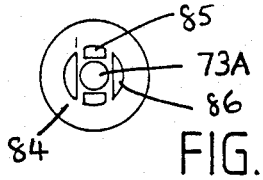
FIGS. 10–13 represent various configurations of valve member for use in the present invention taken along lines A—A of FIG. 7.

In FIGS. 7–8 there is shown a suitable form of decompression valve 69 which may be located in a top wall 70 of piston 22 or 22A. Valve 69 includes movable valve member 71 and a round head 72. Stem 73 of circular cross section may be slidably adapted for reciprocatable movement in valve bore 74 in contact with bearing ribs 75. Spring 76 is shown in the base of bore 74 and held therein by circlip 77. Also shown are hollow spaces 78 of piston 22 or 22A and piston rod 79.

In operation valve 69 is open due to the action of spring 76 at bottom dead centre (BDC) when engine 10 is not running. The valve 69 may close when the pressure in the combustion chamber above piston 22 or 22A rises due to the piston approaching top dead centre (TDC). As the valve closes the engine will fire and after firing the pressure in the combustion chamber above piston 22 or 22A rises rapidly thus keeping valve 69 shut by the pressure in the chamber being greater than the restoring force of spring 76. When the valve 69 is open gases may escape from the chamber above piston 22 or 22A through exhaust port 80 to the chamber below the piston as best shown in FIG. 8 by the arrows. FIG 7 shows the valve in the closed position.

However, the valve 69 will be closed except upon starting the engine as described above because in the downstroke when piston 22 or 22A approaches BDC, gases will be transferred to the chamber above the piston through transfer port 46 thus creating a vacuum or area of reduced pressure which will keep the valve 69 closed. On the upstroke approaching the TDC the valve 69 will be kept closed as described above.

Figure 9:
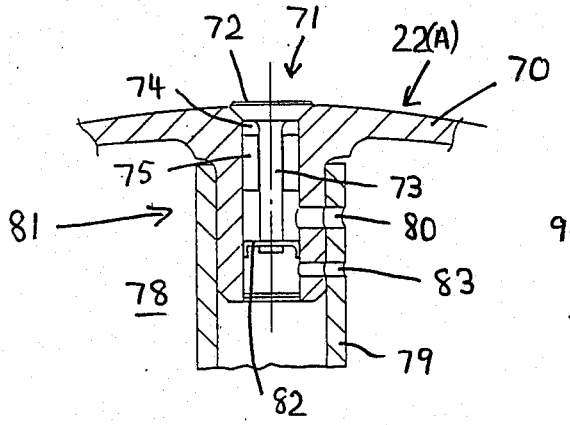
FIG. 9 is a view of a modified decompression valve for use in the present invention.

In FIG. 9 there is shown a modified decompression valve 81. In valve 8 the valve member 71 is attached to piston 82. There is also included a vacuum port 83. Valve 81 is open when the motor 10 is not running.

Upon starting of the engine and upon the first revolution of the pull stroke the pressure in the chamber below piston 22 or 22A will keep valve 81 open. However as piston 22 or 22A passes through BDC the chamber below piston 22 is reduced in pressure to thereby close valve 81 by gases escaping through port 83. As piston 22 or 22A approaches TDC the pressure in the top chamber above the piston will keep valve 81 closed.

The fundamental advantage of inclusion of a decompression valve in the top wall of piston 22 or 22A is that when the decompression valve is in the open position access is provided for gases in the top chamber above the position to flow through to the bottom chamber. This means that the pressure in the top chamber will be substantially reduced this making it much easier to start the engine. It is believed that an effective reduction of 40% in top chamber pressure may be achieved. Thus usually the pressure in the top chamber will be of the order of 130–150 psi in a conventional two stroke engine. In a two stroke engine constructed in accordance with the invention the pressure may be reduced to around 70–90 psi.

Figure 11:
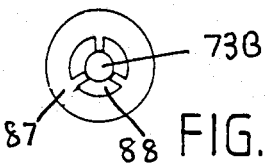
Figure 12:
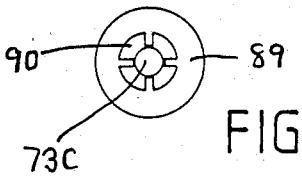
Figure 13:
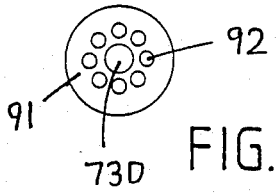

Various forms of porting is illustrated in FIGS. 10–13 for valves 69 or 81 for allowing access for air included in the top chamber to flow through to the bottom chamber. Thus in FIG. 10 reference is made to valve stem 73A extending through a guide member 84 with ports 85 and 86. FIG. 11 shows valve stem 73B extending through a guide member 87 or guide ribs 87 thereby providing access ports 88. FIG 12 shows guide member 89 and ports 90 surrounding valve stem 73C. FIG. 33 shows guide member 91 surrounding valve stem 73D with access ports 92.

Advantages obtainable by two stroke motor of the invention and as shown in the preferred embodiment include the following (i) Substantial reduction may now be achieved in piston housing friction because piston may now have uniform speed in the housing and thus increased speeds at the extremities of movement of the piston which were a legacy of the prior art may now be substantially eliminated. Because of this the engine will run at a cooler temperature and higher rotational speed in revolutions per minute may be attained;

(ii) The crankshaft may now be formed from relatively light material such as aluminum which reduces weight and facilitates use of an internal electronic ignition unit in the crankcase;

(iii) The crankshaft oil seals may now be eliminated because oil does not have to gain access to the crankshaft;

(iv) Because the piston and connecting rod are in one piece this eliminates the need for piston pins, bearing circlips and several machining hardening and grinding operations;

(v) The slide block can be formed from relatively light material such as an acetal resin sold by E. I. de Pont de Nemours & Co. Inc. under the trademark DELRIN to reduce weight, wear and noise;

(vi) As shown in FIG. 4 the entire engine assembly may be dismantled and rebuilt in minimum time;

(vii) The piston housing may have an internal chamber of reduced volume for greater efficiency;

(viii) The engine facilitates the use of an internal decompressor which may be fitted to the piston;

(ix) The force or thrust on the crankpin is in a straight line and thus a higher proportion of thrust may be transmitted to the crankpin;

(x) The use of the slide block and mounting bracket reduces inertia stresses;

(xi) There is an effective reduction in the number of components required to build engine;

(xii) The piston housing or cylinder may be formed from aluminum due to (i) above thus providing a reduced overall weight.

(xiii) The slide block is self adjustable thus reducing noise even when the engine is worn:

(xiv) The crankcase is separate from the piston housing thus reducing the corrosive effect of burnt gases;

(xv) The engine is easier and cheaper to manufacture due to the minimal amount of tooling required;

(xvi) The engine is versatile in application and can be applied to any small engine situation, and (xvii) The engine may be fitted to an existing mower frame or new mower frame as the case may be.

What is claimed is:

1. A single cylinder two stroke engine comprising: a single piston housing; a piston located in the piston housing; a transfer port; an inlet port in the piston housing; a connecting rod integral with or otherwise secured to the piston; a crankcase located adjacent to the piston housing and sealed therefrom; a crankshaft in the crankcase; pivotal connection means between the crankshaft and connecting rod; a magnet located in the crankshaft; ignition means mounted inside the crankcase adjacent the crankshaft for passage of the magnet by the ignition means to effect firing of the engine.

2. A two stroke engine as claimed in claim 1, wherein said pivotal connection means includes a crankpin on said crankshaft and said magnet is located colinear with the axis of the crankshaft and the crankpin.

3. A two stroke engine as claimed in claim 1 wherein the piston housing has a base wall which seals the interior of the piston housing from the interior of the crankcase.

4. A two stroke engine as claimed in claim 1 wherein the pivotal connection means includes a mounting bracket or yoke integral with or rigidly secured to the connection rod and there is further provided a mounting block or roller slidably mounted for reciprocatable movement within the mounting bracket or yoke.

5. A two stroke engine as claimed in claim 4 wherein the pivotal connection means has a crankpin integral with or rigidly secured to the crankshaft.

6. A two stroke engine as claimed in claim 1 wherein the ignition means is fixedly mounted to an interior surface of the crankcase.

7. A two stroke engine as claimed in claim 1 wherein the ignition means is movable within the crankcase to achieve a position in advance or retard of top dead centre (TDC).

8. A two stroke engine as claimed in claim 7 wherein an advance position is up to 35 degrees in advance of TDC and a retard position is up to 5 degrees in retard of TDC.

9. A two stroke engine as claimed in claim 7 wherein the ignition means is mounted on a mounting member which may be selectively rotated within the crankcase to achieve the advance position or the retard position.

10. A two stroke engine as claimed in claim 1 wherein there is further provided a decompression valve in a top part of the piston to achieve easier starting of the engine.

11. A two stroke engine as claimed in claim 10 wherein the decompression valve includes a valve member movable in a mating bore in the piston so that when the valve is in an open position gases from a top chamber in the piston housing above the piston may flow therethrough to a bottom chamber in the housing below the piston.

12. A two stroke engine as claimed in claim 11 wherein a side wall of the mating bore includes an exhaust port for flow of said gases.

13. A two stroke engine as claimed in claim 12 wherein the valve member is biassed by a compression spring or other resilient member to an open position.

14. A two stroke engine as claimed in claim 11 wherein the decompression valve is vacuum operated wherein there is further included a vacuum port in the side wall of the mating bore and said valve member is provided with a piston at a bottom end thereof.

15. A two stroke engine as claimed in claim 11 wherein the valve member is adapted for bearing contact with one or more guide members in the mating bore.

16. A two stroke engine as claimed in claim 15 wherein the guide members are provided with one or more access ports.

17. A single two stroke engine comprising: a piston housing; a piston located in the piston housing; decompression valve means including a decompression valve movable in a mating bore of the piston and means for positioning said decompression valve in an open position during a portion of the initial upward movement of the piston for allowing gases from a top chamber in the piston housing to flow through the piston to a bottom chamber in the piston housing below the piston; a transfer port; an inlet port in the piston housing; a connecting rod integral with or otherwise secured to the piston; a crankcase located adjacent to the piston housing and sealed therefrom; a crankshaft in the crankcase; pivotal connection means between the crankshaft and connecting rod; and ignition means.

18. A single cylinder two stroke engine comprising: a piston housing; a piston located in the piston housing; decompression valve means including a decompression valve movable in a mating bore of the piston and means for positioning said decompression valve in an open position during a portion of the initial upward movement of the piston for allowing gases from a top chamber in the piston housing to flow through the piston to a bottom chamber in the housing below the piston; a transfer port; an inlet port in the housing; a connecting rod integral with or otherwise secured to the piston; a crankcase located adjacent to the piston housing and sealed therefrom; a crankshaft in the crankcase; pivotal connection means between the crankcase and connection rod, a magnet located in the crankshaft; and ignition means mounted inside the crankcase and adjacent the crankshaft for passage of the magnet by the ignition means to effect firing of the engine.

* * * * *